US009669532B1

(12) United States Patent
Mayer

(10) Patent No.: US 9,669,532 B1
(45) Date of Patent: Jun. 6, 2017

(54) RATCHETING MULTI-TOOL

(71) Applicant: James Mayer, Aptos, CA (US)

(72) Inventor: James Mayer, Aptos, CA (US)

( * ) Notice: Subject to any disclaimer, the term of this patent is extended or adjusted under 35 U.S.C. 154(b) by 102 days.

(21) Appl. No.: 14/721,593

(22) Filed: May 26, 2015

(51) Int. Cl.
*B25F 1/00* (2006.01)
*B25F 1/04* (2006.01)
*B25B 7/22* (2006.01)

(52) U.S. Cl.
CPC ..... *B25F 1/003* (2013.01); *B25B 7/22* (2013.01); *B25F 1/04* (2013.01)

(58) Field of Classification Search
CPC .... B25F 1/003; B25F 1/04; B25F 1/02; B25F 1/00; B25B 7/00; B25B 7/22; B25B 13/56; B25B 15/008; B25G 1/102; B25G 1/085; B25G 1/00; B25G 1/08
USPC ..... 7/125, 127, 128, 167, 168, 164, 118; 81/489–492, 300, 427.5, 177.4, 440
See application file for complete search history.

(56) References Cited

U.S. PATENT DOCUMENTS 896,746 A * 8/1908 McCarty ..... B25F 1/003 30/143
1,628,467 A * 5/1927 Mandl ..... B25B 13/463 81/60
3,946,453 A * 3/1976 Torres ..... B25F 1/003 7/127
4,238,862 A * 12/1980 Leatherman ..... B25B 7/22 7/128
5,251,353 A * 10/1993 Lin ..... B25B 7/00 7/107
D410,833 S 6/1999 Hasegawa
6,243,901 B1 * 6/2001 Elsener ..... B25F 1/003 30/161
6,286,397 B1 9/2001 Taggart
6,481,034 B2 11/2002 Elsener
7,000,323 B1 2/2006 Hatcher
7,913,591 B2 * 3/2011 Nenadic ..... B25F 1/04 7/118
7,926,136 B2 * 4/2011 Yale ..... B25F 1/02 30/156
7,997,170 B1 * 8/2011 Martinez ..... B25B 7/00 7/128
8,166,850 B2 * 5/2012 Caniparoli ..... B25G 1/085 7/137
8,516,640 B2 8/2013 Merten
8,549,687 B1 10/2013 Alexander
(Continued)

FOREIGN PATENT DOCUMENTS

CN 2758030 2/2006

*Primary Examiner* — Hadi Shakeri

(57) ABSTRACT

The ratcheting multi-tool includes a first armature and a second armature. The first armature and the second armature pivot about a first point and a second pivot point. The first armature and the second armature extend to form a set of pliers. The first armature is further defined with a first distal end from which a ratcheting tool is pivotably engaged. The ratcheting tool is able to rotate to an extended position in order to be used as a socket ratchet. The second armature includes a second multi-tool that is pivotably engaged, and extends in order to provide a set of second tools therefrom. The first armature includes a belt clip and a spring-loaded clip. The ratcheting tool is aside of the first armature; whereas the first armature is generally parallel with the second armature.

7 Claims, 5 Drawing Sheets

(56) References Cited

U.S. PATENT DOCUMENTS

| | | | | |
|---|---|---|---|---|
| 8,616,096 | B2 * | 12/2013 | Brown | B25B 15/02 81/177.4 |
| 2003/0014868 | A1 * | 1/2003 | Cech | A01G 3/0475 30/296.1 |
| 2008/0163433 | A1 * | 7/2008 | Nenadic | B25F 1/04 7/128 |
| 2013/0025071 | A1 | 1/2013 | Keng | |
| 2013/0305460 | A1 * | 11/2013 | Richards | B25F 1/02 7/168 |

* cited by examiner

RATCHETING MULTI-TOOL

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of multi-tools, and more specifically, a multi-tool that includes a ratcheting tool.

SUMMARY OF THE INVENTION

The ratcheting multi-tool includes a first armature and a second armature. The first armature and the second armature pivot about a first point and a second pivot point. The first armature and the second armature extend to form a set of pliers. The first armature is further defined with a first distal end from which a ratcheting tool is pivotably engaged. The ratcheting tool is able to rotate to an extended position in order to be used as a socket ratchet. The second armature includes a second multi-tool that is pivotably engaged, and extends in order to provide a set of second tools therefrom. The The ratcheting tool is aside of the first armature; whereas the first armature is generally parallel with the second armature.

These together with additional objects, features and advantages of the ratcheting multi-tool will be readily apparent to those of ordinary skill in the art upon reading the following detailed description of presently preferred, but nonetheless illustrative, embodiments of the ratcheting multi-tool when taken in conjunction with the accompanying drawings.

In this respect, before explaining the current embodiments of the ratcheting multi-tool in detail, it is to be understood that the ratcheting multi-tool is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the ratcheting multi-tool.

It is therefore important that the claims be regarded as including such equivalent construction insofar as they do not depart from the spirit and scope of the ratcheting multi-tool. It is also to be understood that the phraseology and terminology employed herein are for purposes of description and should not be regarded as limiting.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
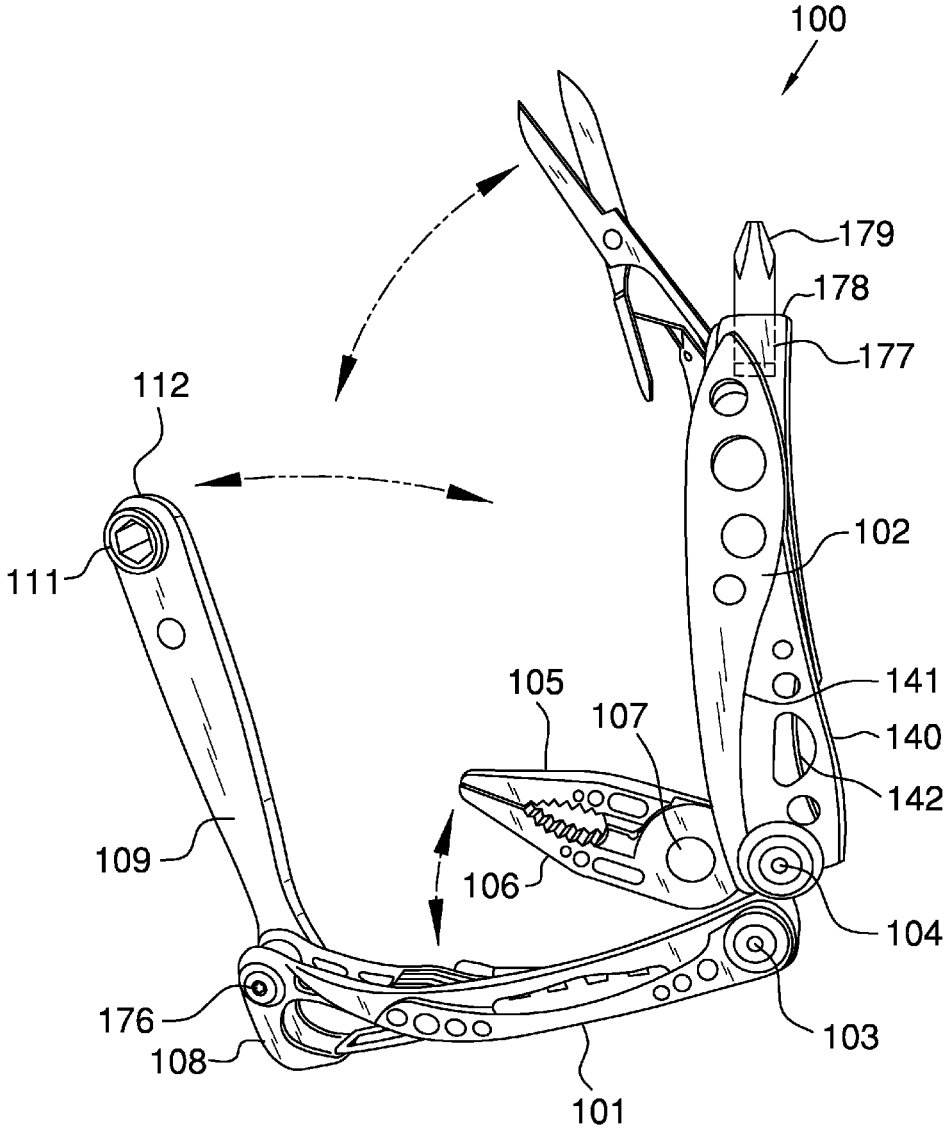
FIG. 1 is a perspective view of an embodiment of the disclosure.
Figure 2:
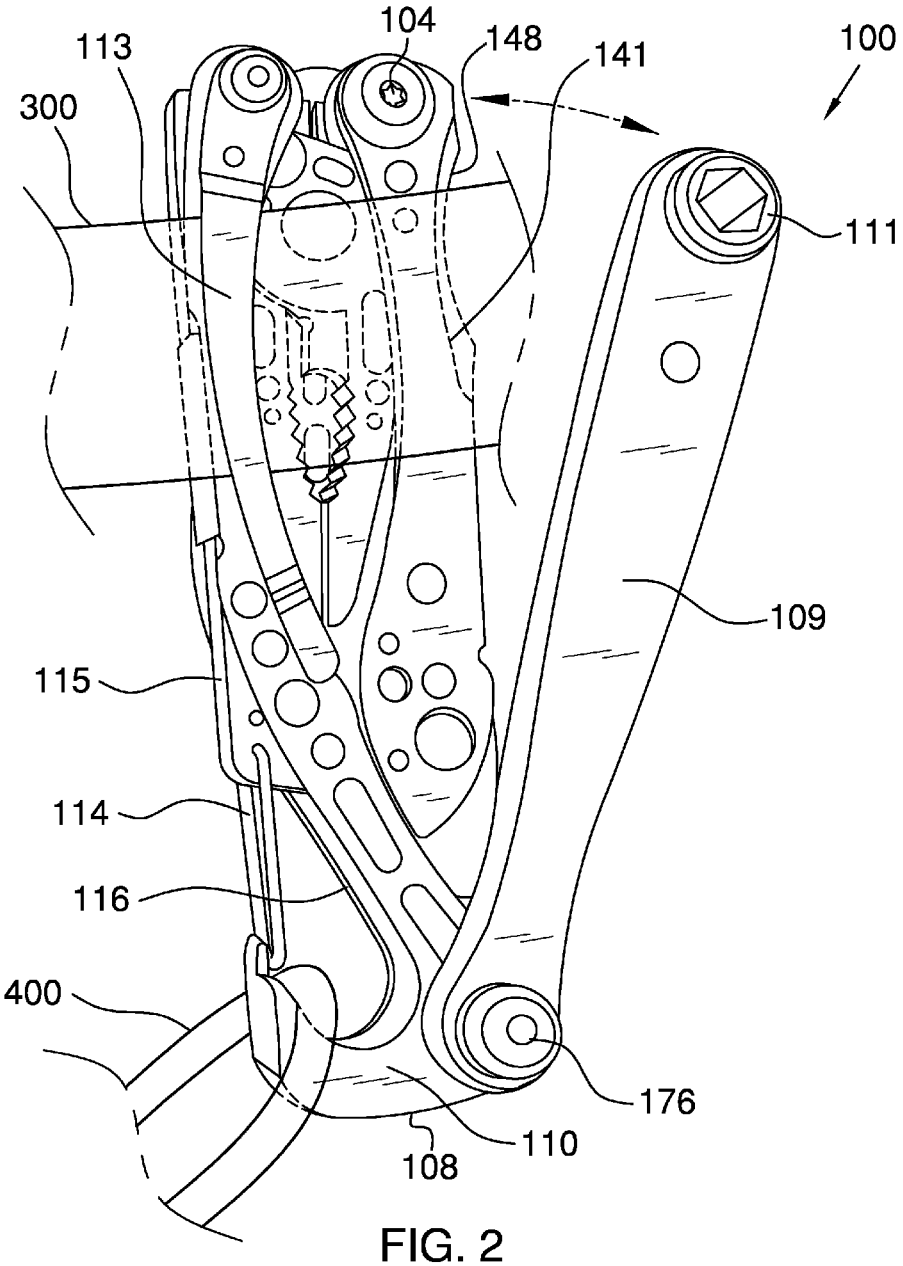
FIG. 2 is a partially collapsed view of an embodiment of the disclosure.
Figure 3:
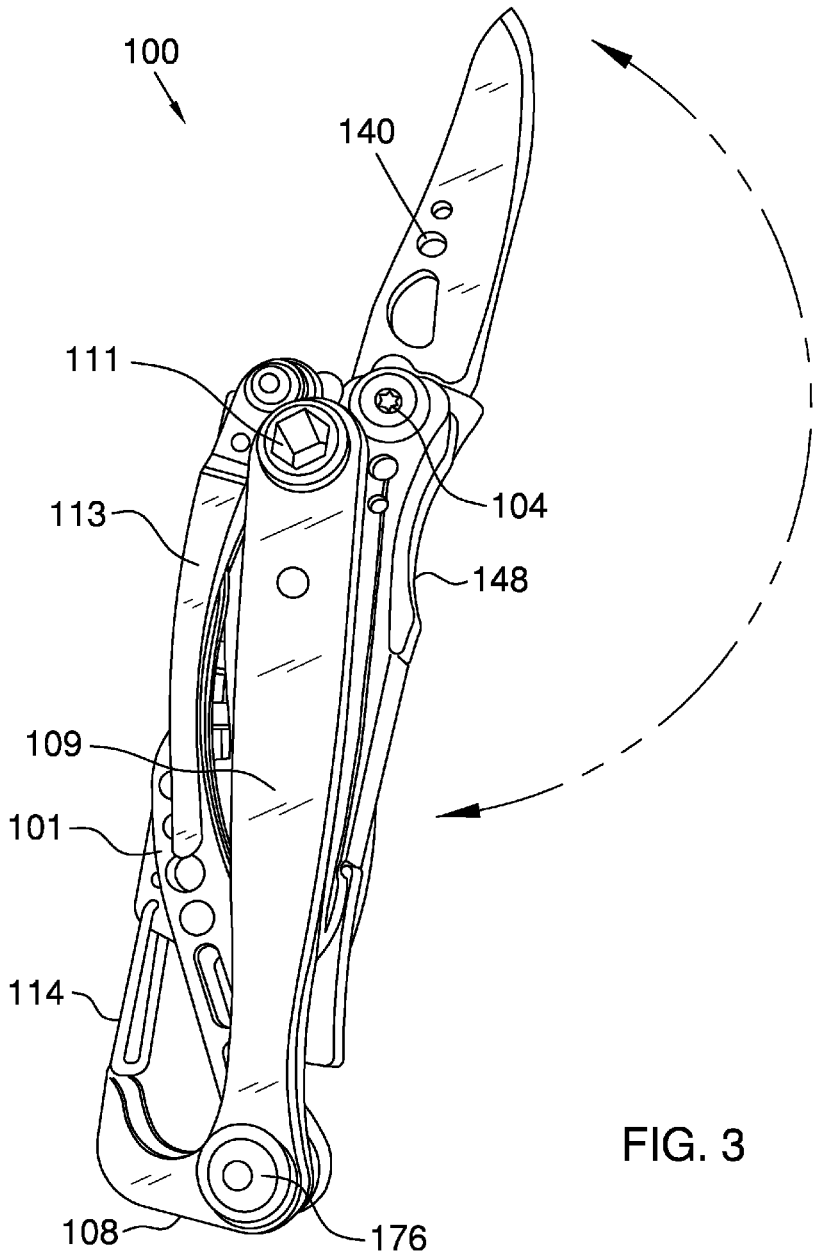
FIG. 3 is a view of a knife extended of an embodiment of the disclosure.
Figure 4:
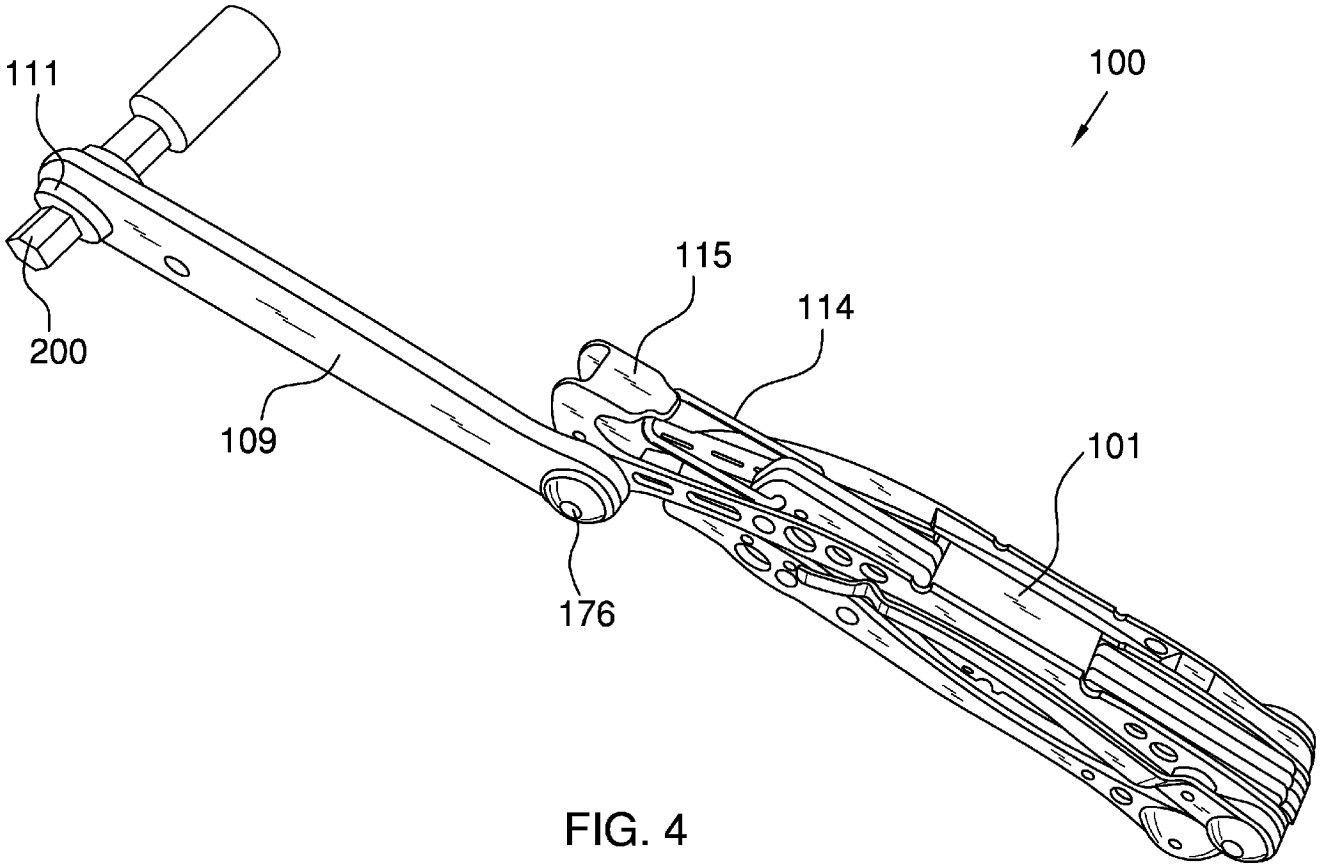
FIG. 4 is a perspective view of an embodiment of the disclosure in use.
Figure 5:
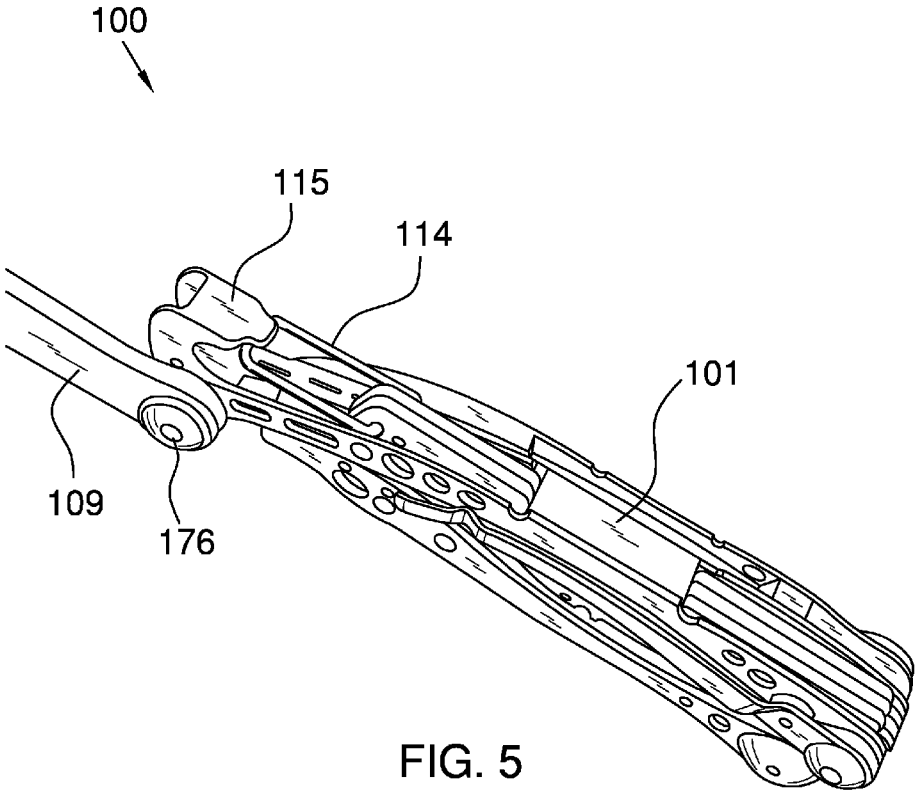
FIG. 5 is another perspective view of an embodiment of the disclosure.

As best illustrated in FIGS. 1 through 5, the ratcheting multi-tool 100 (hereinafter invention) generally comprises a first armature 101 and a second armature 102. The first armature 101 pivots with respect to a first pivot point 103; whereas the second armature 102 pivots with respect to a second pivot point 104. A first pliers member 105 is pivotably engaged to the first pivot point 103. A second pliers member 106 is pivotably engaged to the second pivot point 104. The first plier member 105 is pivotably engaged with respect to the second plier member 106 via a third pivot point 107. The first and second pliers members 105 and 106, pivot in order to provide a plier tool function, which is articulated via the first armature 101 and the second armature 102 pivoting with respect to the first pivot point 103 and second pivot point 104, respectively.

The first armature 101 and the second armature 102 are generally parallel with one another. The first armature 101 is further defined with a first distal end 108 that is pivotably engaged to a ratcheting tool 109. The ratcheting tool 109 is generally parallel with the first armature 101. Moreover, the ratcheting tool 109 is able to rotate 360 degrees with respect to the first distal end 108. Moreover, the ratcheting tool 109 is able to fold against an inner armature surface 110. The ratcheting tool 109 includes a ratchet member 111 adjacent to a ratcheting tool distal end 112. The ratchet member 111 is configured to tighten or loosen a hexagonally-shaped fastener 200. It shall be noted that the ratchet member 111 is open in design such that the hexagonally-shaped fastener 200 is able to extend there through when in use.

The ratcheting tool 109 is attached to and rotates with respect to the first distal end 108 of the first armature 101 via a fourth pivot point 176. The fourth pivot point 176 is of identical construction as the first pivot point 103 mentioned above. Moreover, the first pivot point 103 and the fourth pivot point 176 involve a rivet, bolt and nut, screw, or other type of fastener.

The first armature 101 is further defined with a belt clip 113 that is affixed to the first pivot point 103. Moreover, the belt clip 113 is generally parallel with the inner armature surface 110 of the first armature 101. The belt clip 113 is adapted to secure the invention 100 against a belt 300.

The first armature 101 is further defined with a spring-loaded clip 114 that is integrated into the design of the first armature 101. The first armature 101 is further defined with a first lateral side surface 115, which is adjacent to the inner armature surface 110. The first lateral side surface 115 includes the spring-loaded clip 114 thereon. The spring-loaded clip 114 is further defined with a clip recess 116 that is accessible from the first lateral side surface 114. The spring-loaded clip 114 enables an object to be inserted into the clip recess 116 and secured thereto via the spring-loaded clip 114.

The invention 100 includes a second multi-tool 130 that is pivotably engaged with respect to the second armature 102. The second multi-tool 130 is able to nest within the second armature 102. The second multi-tool 130 may resemble or be analogous to a small "Swiss army knife kit".

The second armature 102 includes a knife 140. The knife 140 is able to retract into a knife slot 141 located in the second armature 102. The knife 140 is pivotable engaged with respect to the second armature 102 via the second pivot point 104. The knife 140 is only available for use when the first plier member 105 and the second plier member 106 are fully nested between the first armature 101 and the second armature 102. Moreover, the knife slot 141 is located on an inner second armature surface 142. The knife 140 is locked in a nested state within the knife slot 141. The knife 140 is unlocked in order to rotate out via the second pivot point 104 via a knife lock button 148.

The second armature 102 may include a bit cavity 177 provided on a second distal end 178. The bit cavity 177 enables a screw bit 179 to be inserted thereon. The screw bit 179 is well known in the art, and may be any of a plurality of different styles of screw bits comprising flathead, Phillips, etc.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A ratcheting multi-tool comprising:

a first armature and a second armature;

wherein the first armature includes a ratcheting tool thereon;

wherein the first armature and the second armature are pivotably engaged to form a set of pliers;

wherein the second armature includes a knife;

wherein the second armature includes a pair of scissors that is pivotably engaged;

wherein the first armature pivots with respect to a first pivot point; whereas the second armature pivots with respect to a second pivot point;

wherein a first pliers member is pivotably engaged to the first pivot point;

wherein a second pliers member is pivotably engaged to the second pivot point;

wherein the first plier member is pivotably engaged with respect to the second plier member via a third pivot point;

wherein the first and second pliers members, pivot in order to provide the plier tool, which is articulated via the first armature and the second armature pivoting with respect to the first pivot point and second pivot point, respectively;

wherein the first armature and the second armature are generally parallel with one another; wherein the first armature is further defined with a first distal end that is pivotably engaged to the ratcheting tool;

wherein the ratcheting tool is generally parallel with the first armature; wherein the ratcheting tool is able to rotate with respect to the first distal end;

wherein the ratcheting tool is able to fold against an inner armature surface of the first armature; wherein the ratcheting tool includes a ratchet member adjacent to a ratcheting tool distal end;

wherein the ratchet member is configured to tighten or loosen a hexagonally-shaped fastener; wherein the ratchet member is open in design such that the hexagonally-shaped fastener is able to extend there through when in use;

wherein the ratcheting tool is attached to and rotates with respect to the first distal end of the first armature via a fourth pivot point;

wherein the first armature is further defined with a belt clip that is affixed to the first pivot point;

wherein the belt clip is generally parallel with the inner armature surface of the first armature;

wherein the belt clip is adapted to secure the ratcheting multi-tool against a belt;

wherein the first armature is further defined with a spring-loaded clip that is integrated into the design of the first armature;

wherein the first armature is further defined with a first lateral side surface, which is adjacent to the inner armature surface;

wherein the first lateral side surface includes the spring-loaded clip thereon;

wherein the spring-loaded clip is further defined with a clip recess that is accessible from the first lateral side surface;

wherein the spring-loaded clip enables an object to be inserted into the clip recess and secured thereto via the spring-loaded clip.

2. The ratcheting multi-tool according to claim 1 wherein the pair of scissors is pivotably engaged with respect to the second armature; wherein the pair of scissors is able to nest within the second armature.

3. The ratcheting multi-tool according to claim 2 wherein the second armature includes the knife; wherein the knife is able to retract into a knife slot located in the second armature.

4. The ratcheting multi-tool according to claim 3 wherein the knife is pivotable engaged with respect to the second armature via the second pivot point; wherein the knife is available for use when the first plier member and the second plier member are nested between the first armature and the second armature.

5. The ratcheting multi-tool according to claim 4 wherein the knife slot is located on an inner second armature surface.

6. The ratcheting multi-tool according to claim 5 wherein the knife is locked in a nested state within the knife slot; wherein the knife is unlocked in order to rotate out via the second pivot point via a knife lock button.

7. The ratcheting multi-tool according to claim 6 wherein the second armature include a bit cavity provided on a second distal end; wherein the bit cavity enables a screw bit to be inserted thereon.

* * * * *